United States Patent [19]

Irving

[11] 3,933,259

[45] Jan. 20, 1976

[54] SIDE-SHIFT BACKHOE

[75] Inventor: Alasdair John Irving, Epping, Australia

[73] Assignee: J. I. Case Company, Racine, Wis.

[22] Filed: July 2, 1973

[21] Appl. No.: 375,914

[30] Foreign Application Priority Data

July 3, 1972 Australia ..... 9553/72

[52] U.S. Cl. ..... 214/138 C; 172/435; 180/77 S; 214/730

[51] Int. Cl.[2] ..... B66F 9/00

[58] Field of Search ..... 214/768, 138 C, 730; 180/775; 172/435

[56] References Cited

UNITED STATES PATENTS 3,215,282 11/1965 Wiemann et al. ..... 214/138 C 3,250,410 5/1966 Dorkins ..... 214/138 C

FOREIGN PATENTS OR APPLICATIONS 859,437 1/1961 United Kingdom ..... 214/138 C

*Primary Examiner*—Robert J. Spar

*Assistant Examiner*—Donald W. Underwood

*Attorney, Agent, or Firm*—Cushman, Darby & Cushman

[57] ABSTRACT

This specification discloses a side-shift backhoe having a laterally movable slide supporting an operator's station which is slidable with respect to said slide in a direction parallel thereto. Spaced stop members are provided for engaging the station as the slide moves from side to side whereby the relative position of the slide with respect to the station may be changed in either direction. In an alternative form the operator's station is mounted on a frame supporting the slide and the slide is provided with stop members which engage a projection on the station to move the station relative to the slide.

5 Claims, 4 Drawing Figures

SIDE-SHIFT BACKHOE

This invention relates to improvements in side-shift backhoes and other apparatus having laterally movable working members which require operator control and vigilance.

A side-shift backhoe incorporates a frame which supports the backhoe mechanism and which is mounted for lateral movement with respect to the tractor or the like on which the backhoe is mounted. This type of backhoe was developed primarily for trenching in confined spaces and enables operation closer to obstructions than if the backhoe were mounted centrally of the rear of the tractor.

There are essentially two types of side-shift backhoes: (a) The operator's seat together with a control console are mounted on the backhoe resulting in the operator moving with the backhoe as it is shifted from side to side; (b) the operator's seat and control console are mounted on the tractor so that the operator remains in a fixed position while the backhoe shifts from side to side. Both of these arrangements have some disadvantages. In the case of (a), while the operator is closer to the working area and has a reasonable view thereof, a large cabin is required to enclose all operator positions, some hydraulic hoses must be very long to allow for movement of the slide and the operator's view is somewhat obstructed by the boom and boom cylinder. In the case of (b), a smaller cabin is required and the operator's view is obstructed only when the backhoe is central. However, the operator's view is severely limited when the backhoe is at its extremities, the operator is somewhat remotely positioned from the work area and some hydraulic hoses must be very long, to allow for movement of the backhoe.

It is the object of this invention to obtain the advantages of both of the above arrangements while reducing the disadvantages thereof.

The invention provides an apparatus for earth working or load lifting comprising a supporting frame, a slide member mounted for lateral movement with respect to said frame, a working member mounted on said slide member, and an operator's station having control means for said slide member and said working member, said operator's station being mounted for movement with respect to said slide member, and means provided for controlling the movement of said operator's station whereby the operator's station can be located at an offset position with respect to the working member.

In a preferred form the apparatus is a side shift backhoe mounted on a tractor or the like and the operator's station is slidably mounted on the slide supporting the backhoe so as to be capable of movement from side to side with respect to the backhoe slide. In this way the operator's position can be offset with respect to the centre of the slide so as to give the operator better visibility of the work area while maintaining the operator near the backhoe.

In order that the invention may be more readily understood, a preferred embodiment and alternative embodiment will be described with reference to the accompanying drawings in which.

Figure 1:
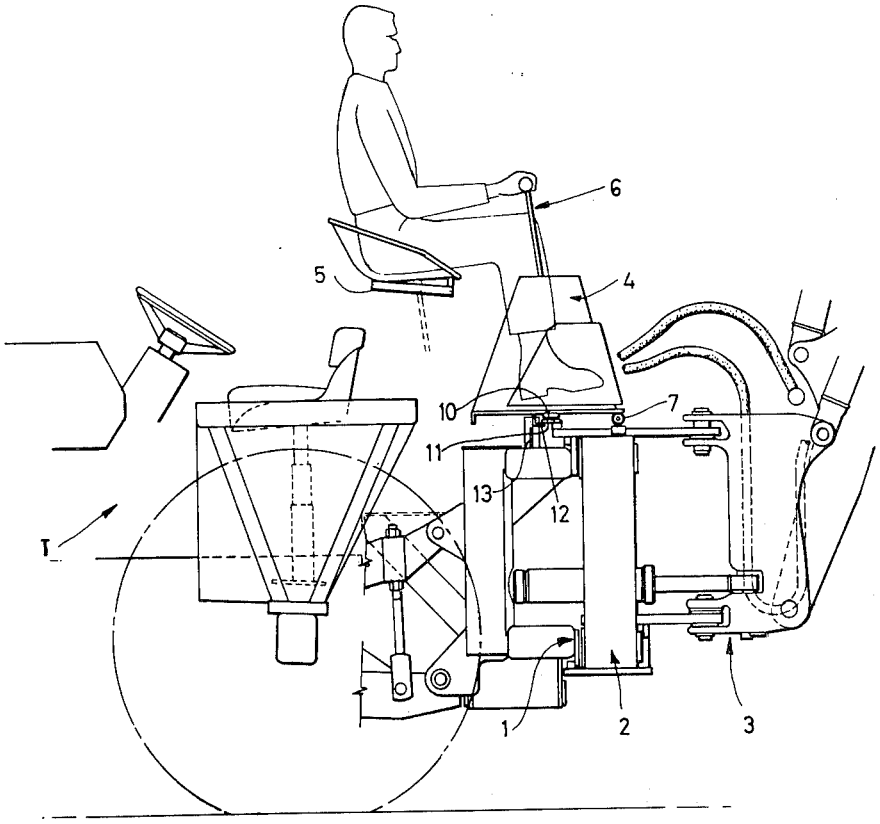
FIG. 1 is a fragmentary side elevation of a tractor having a side-shift backhoe embodying the invention.

The side-shift backhoe shown in the drawings includes a frame 1 suitably secured to the rear of a tractor T and supporting a slide 2 for lateral sliding movement relative to the frame 1. The slide 2 supports a backhoe mechanism 3 in the usual manner. The construction and operation of the frame 1, slide 2 and backhoe 3 is well-known and will not be described further.

Figure 2:
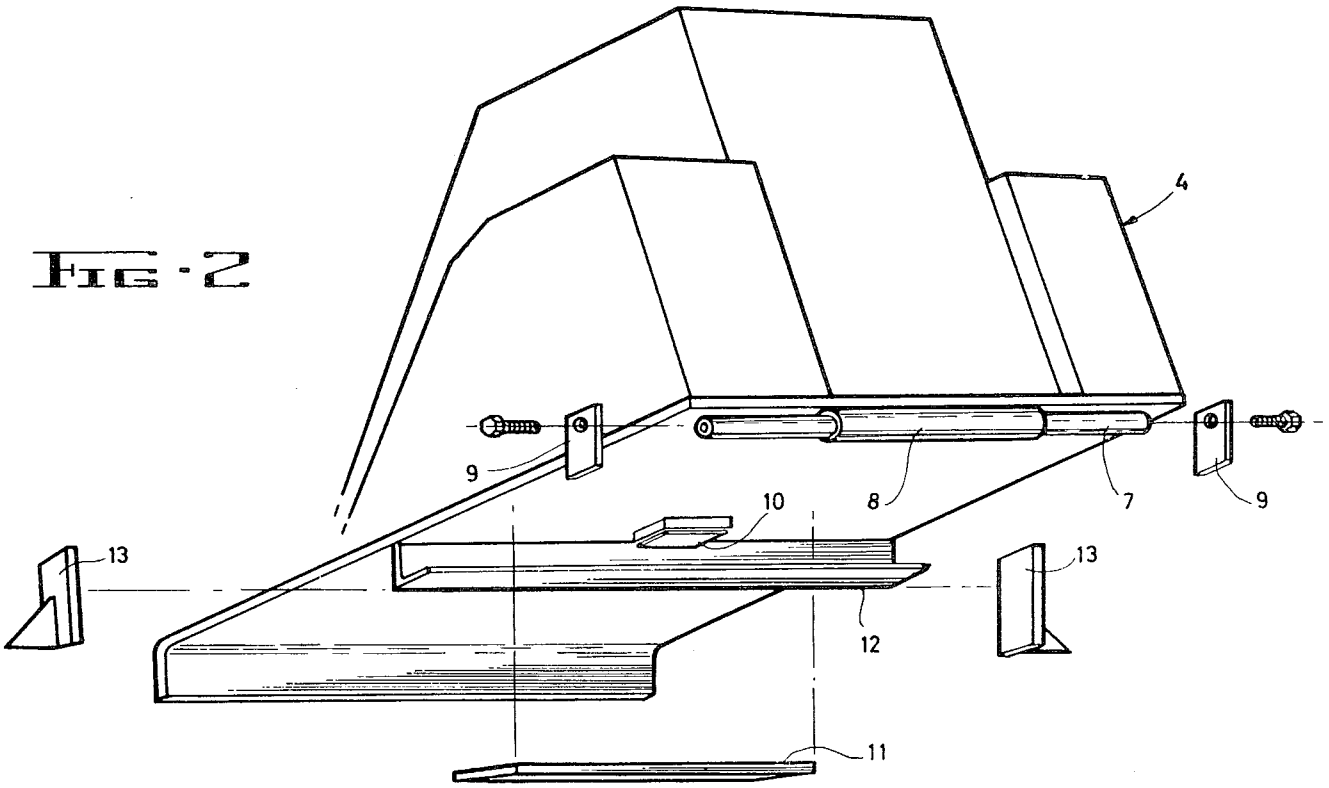
FIG. 2 is a perspective view from beneath the operator's station of the backhoe of FIG. 1.

The slide 2 supports an operator's station 4 which is mounted for parallel sliding movement with respect to the slidee 2 and incorporates an operator's seat 5 and the controls 6 for movement of the backhoe and slide 2. The operator's station 4 is mounted on the slide 2 through a slide rod 7 passing through a sleeve 8 (FIG. 2) secured to the floor of the operator's station 4 and fixed to brackets 9 welded to the slide structure 2. A brass wear pad 10, also secured to the floor of the operator's station 4, bears on flat track 11 welded to the slide structure 2. An angle section 12 is welded to the floor of the operator's station 4 and has one of its flanges positioned under the horizontal flange of the section 11. Vertical stops 13 are fixed to the frame 1 and are engaged by the section 12 to facilitate location of the operator's station 4 as discussed below.

The operator's station 4 is moved with respect to the slide 2 by the movement of slide 2 while the angle section 12 on the operator's station 4 is bearing against either of the vertical stops 13. In this embodiment the movement of slide 2 is brought about by the reaction from the digging cylinders on the backhoe 3 during a simulated digging operation to the side of the tractor, the slide locking system, in this case four hydraulic cylinders, being previously released. The slide locking system is well known in other slide applications. The slide 2 has a movement of about twenty one inches to either side of the centre-line of the tractor. The stops 13 are positioned so that the centre-line of the operator's station 4 can move about a foot to either side of the tractor centre-line.

Figure 3:
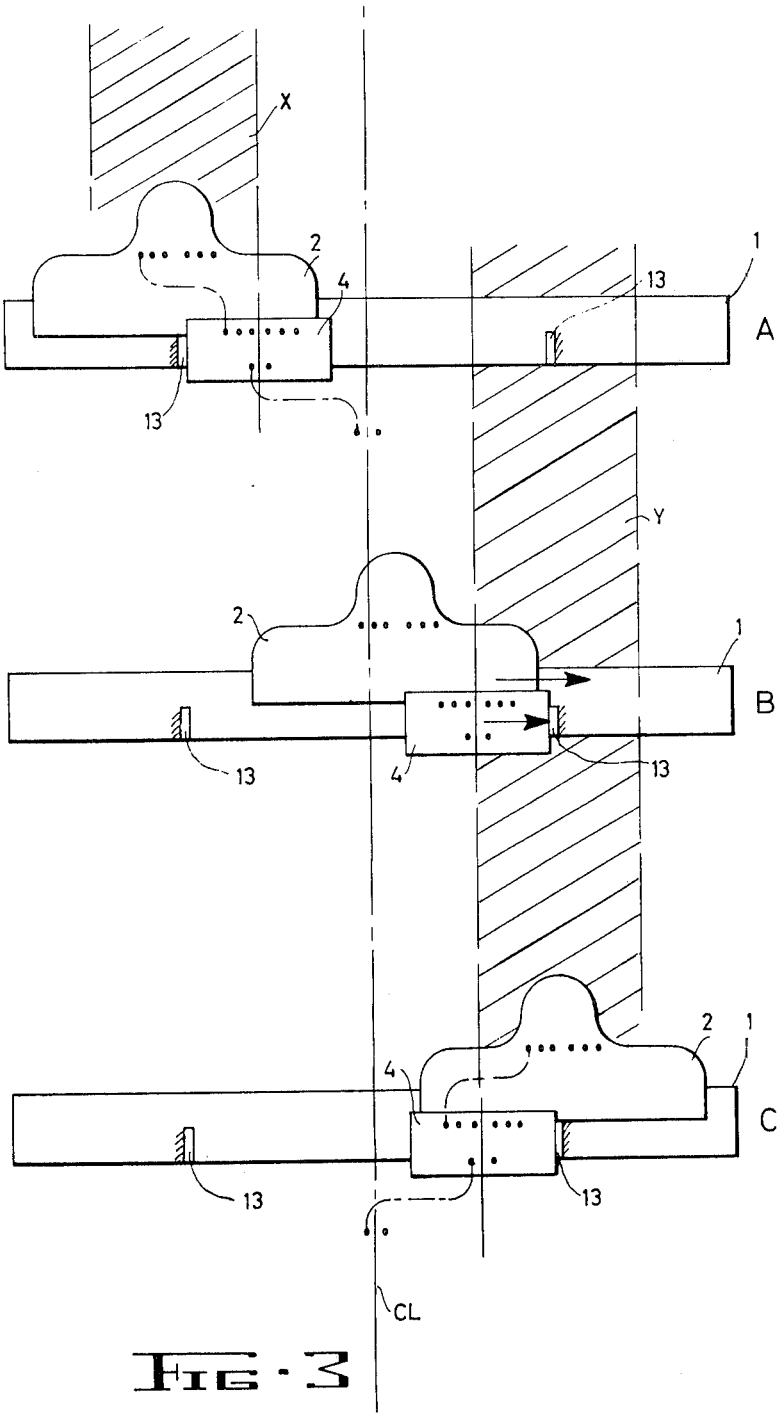
FIG. 3 is a series of schematic views showing the various positions of the apparatus of FIG. 1.

As will be clear from the above and from FIG. 3, the operator's station 4 may be moved from side to side with respect to the backhoe slide 2. In view A of FIG. 3, both the backhoe slide 2 and the operator's station 4 are at the extremities of their travel to the left of the centre-line CL of the tractor. In this position the operator is in full view of the work being done on the trench X centred on the centre-line of the slide 2. In view B, the operator's station 4 is still in the same position in relation to the slide 2 and has just engaged stop 13. Any further movement on slide 2 in the direction of the arrow will produce relative movement between slide 2 and operator's station 4. In view C the relative movement has been completed and operator's station 4 is now at the left hand side of slide 2 which has reached the extremity of its travel and is now centred on trench Y. Operator's station 4 is now positioned for full view of trench Y and has only traversed a total distance of 24 inches, compared with 42 inches, the distance traversed by slide 2.

The advantages of this arrangement are that the operator has complete flexibility of position for one tractor position. Under all circumstances the operator can position himself for a clear view of the work area. Furthermore, the hydraulic hoses between the operator's station 4 and the slide 2 require only 9 inches of movement to either side of the slide centre-line and the hoses between the operator's station 4 and tractor require only 12 inches of movement either side of the tractor centre-line. This is a good deal less than with the prior art arrangements.

Figure 4:
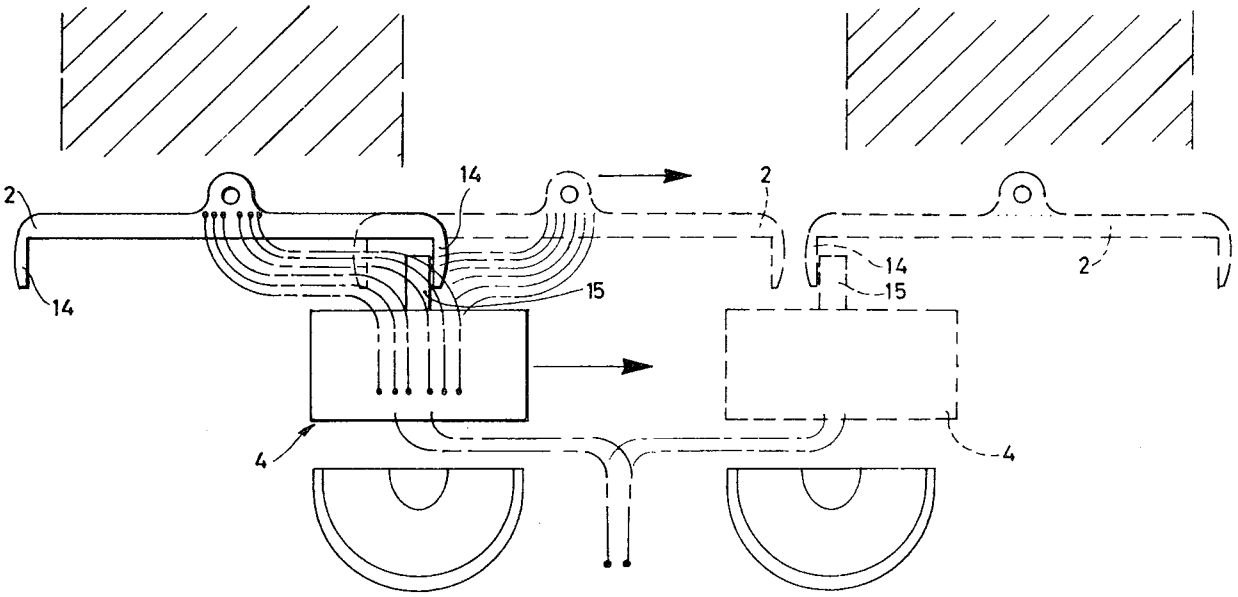
FIG. 4 is a schematic view of an alternative embodiment showing the various positions thereof.

In the alternative of FIG. 4, the operator's station is slidably mounted on frame 1. The backhoe slide 2 is provided with stops 14 which engage a projection 15 on the operator's station 4. The travel of the slide 2 moves the operator's station 4 along frame 1 to any position between the two extremes shown in FIG. 4. The operator's station 4 is movable in the same manner as the operator's station illustrated in FIG. 1 with the exception that the operator's station is mounted to the frame 1 with stops on the slide 2 pushing the operator's station between the same limited positions as in the embodiment of FIG. 1. The operator's station can be mounted on the frame by any suitable means known in the art such as, for example, by means of rollers or a support bar riding over a channel affixed to the frame with grease or other lubricants providing a reduced coefficient of friction between the bar and the channel. In this arrangement the maximum hose traverses are the same as above and operation and advantages are likewise as above.

It will be appreciated that movement of the station 4 may alternatively be effected by means such as hydraulic cylinders controlled by the operator.

It will also be appreciated that the invention may extend to applications other than backhoes. Any device requiring operator control and vigilance may use the inventive concept.

What I claim is:

1. A side-shift backhoe comprising a supporting frame for connection to a tractor, a slide member mounted on and for lateral movement with respect to said frame, a working member mounted on said slide member, and an operator's station having control means for said slide member and said working member, said operator's station being slidably mounted on said slide member for movement parallel to said slide member, stop members secured to said frame in spaced relation at either side of said station, said stop members being engaged by said station as said slide member moves with respect to said frame whereby the relative position of said station with respect to said slide member may be changed in either direction.

2. A side-shift backhoe comprising a supporting frame for connection to a tractor, a slide member mounted on and for lateral movement with respect to said frame, a working member mounted on said slide member and an operator's station having control means for said slide member and said working member, said operator's station being slidably mounted on said frame for lateral offset parallel movement with respect to said frame and said slide member, stop members extending from either end of the slide member, and a projection on said station adapted to be engaged by said stop members as the slide member moves with respect to said frame whereby the relative position of the slide to the station may be changed in either direction.

3. A backhoe according to claim 1, wherein said station is slidably mounted by means of a sleeve secured to the station, a rod engaging said sleeve and secured to said slide member, and a pad member on said station adapted to engage a track on said slide member.

4. An apparatus for earth working or load lifting comprising a supporting frame, a slide member mounted on and for lateral movement with respect to said frame, a working member mounted on said slide member, an operator's station being slidably mounted on and for lateral offset parallel movement with respect to said slide member, control means mounted in said operator's station for controlling said slide member and said working member, and means for controlling the movement of said operator's station whereby the operator's station can be located at an offset position with respect to the working member, said means for controlling comprising stop members positioned on said frame to engage said operator's station as said slide member moves with respect to said frame whereby the relative position of the station to the slide may be changed in either direction.

5. An apparatus for earth working or load lifting comprising a supporting frame, a slide member mounted on and for lateral movement with respect to said frame, a working member mounted on said slide member, an operator's station being slidably mounted on said frame for lateral offset parallel movement with respect to said frame and said slide member, control means mounted in said operator's station for controlling said slide member and said working member, and means for controlling the movement of said operator's station wherein the operator's station can be located at a lateral offset position with respect to the working member by movement of said operator's station with respect to said working member said controlling means comprising stop members extending from either end of the slide member, and a projection on said station adapted to be engaged by said stop members as the slide member moves with respect to said frame whereby the relative position of the slide to the station may be changed in either direction.

* * * * *